United States Patent [19]

Lovick, Jr.

[11] 4,255,753

[45] Mar. 10, 1981

[54] ANTENNA CONSTRUCTION FOR REDUCING SIDE LOBES OF THE RADIATION PATTERN

[75] Inventor: Edward Lovick, Jr., Northridge, Calif.

[73] Assignee: Lockheed Corporation, Burbank, Calif.

[21] Appl. No.: 52,607

[22] Filed: Jun. 27, 1979

[51] Int. Cl.[3] ..... H01Q 13/00

[52] U.S. Cl. ..... 343/786; 343/895

[58] Field of Search ..... 343/786, 895; 333/95

[56] References Cited

U.S. PATENT DOCUMENTS 3,732,571 5/1973 Neale ..... 343/786

FOREIGN PATENT DOCUMENTS 237934 6/1967 U.S.S.R. ..... 343/786

*Primary Examiner*—David K. Moore

*Attorney, Agent, or Firm*—Lowell G. Turner

[57] ABSTRACT

A construction for reducing the side lobe energy emitted from antennas, particularly horn antennas, and thereby attenuating unwanted coupling with adjacent antennas, the construction utilizes a continuous helical coil located on the interior surface of the antenna horn in order to progressively delay the current flowing along the horn wall by causing the current to follow a longer path than that portion of the wave which propagates well away from the wall, the number of coil turns being selected to cause the portion of the E plane which arrives at the horn aperture to be out of phase by approximately one-half wave length with the portion of the E plane propagated away from the horn wall so that it will cancel the E plane energy at the aperture.

5 Claims, 7 Drawing Figures

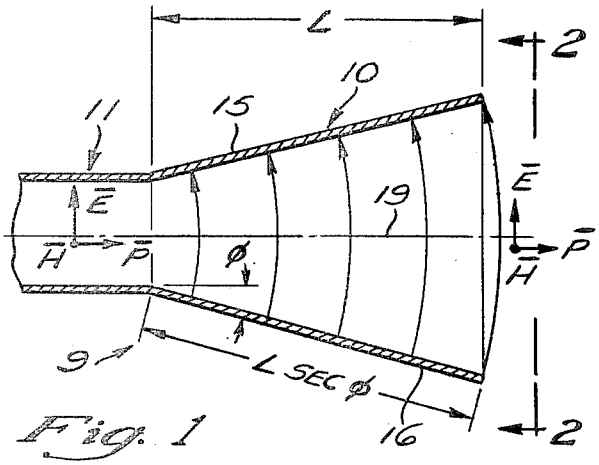
Fig. 1
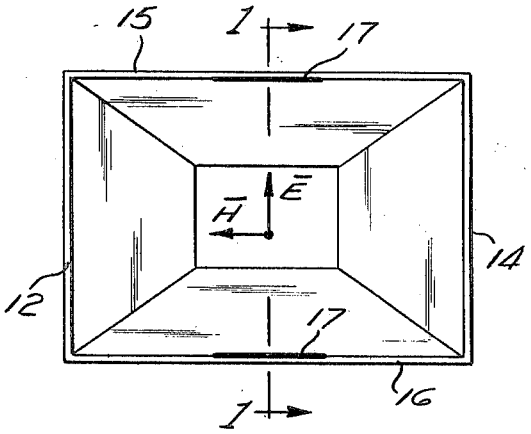
Fig. 2
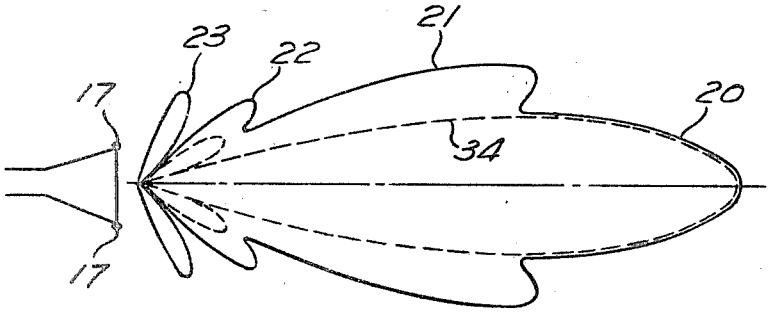
Fig. 3
Fig. 4
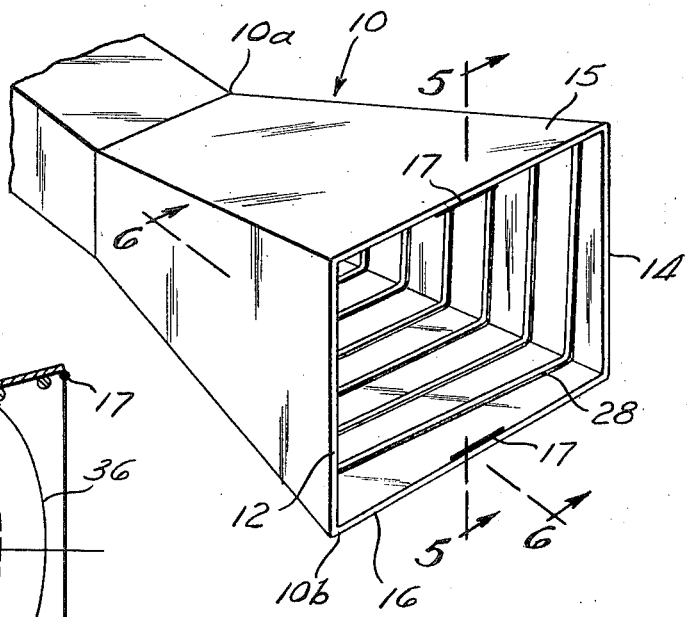
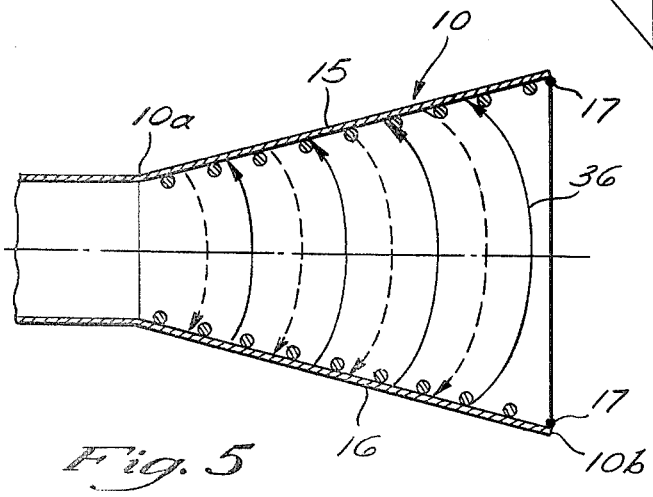
Fig. 5

ANTENNA CONSTRUCTION FOR REDUCING SIDE LOBES OF THE RADIATION PATTERN

BACKGROUND OF INVENTION

When antennas are installed in proximity to one another on aircraft or other objects, there can be interaction between the fields of the antennas resulting in unwanted coupling between the antennas. Attempts have been made to reduce the side lobe energy emitted from the antennas, particularly horn antennas, in order to attenuate this unwanted coupling between the antennas. Corrugated surfaces on the internal walls of a horn antenna have been used in an attempt to accomplish this. The theory of the corrugated surface is that each depression in the corrugation acts as a short-circuited waveguide one quarter wavelength deep to a surface wave traveling across it, so that the reflected energy from it is in opposite phase to the incident energy and will tend to cancel it out, thereby reducing the side lobes energy. However, such corrugated surfaces are difficult and expensive to fabricate. Another means utilized to reduce the side lobe energy consists of placing an absorbing hood forward of the aperture of the antenna horn in order to absorb energy from the side lobes, but such structure consumes space and may interfere with the use of the antenna.

SUMMARY OF THE INVENTION

The present invention provides a simple means for reducing the E plane side lobes of the radiation pattern characteristic of a conventional horn antenna. Such antennas may consist of four plane metallic surfaces, two opposites of which may be arranged at an angle to the axis of all four. Also, such antennas may be made as a conical surface (usually part of a right circular cone). The basic principal by which the side lobe levels are reduced is the delay of the portion of the electric field of the passing wave at the surface of the antenna horn long enough so that when this portion arrives at the horn aperture it is out of phase with another portion of the electric field of the wave and is canceled. A helical coil is located on the interior surface of the antenna horn to progressively delay the wave of current flowing along the horn antenna top and bottom walls, because it must follow a longer path than that portion of the wave which propagates well away from these walls. There is normally a curving of the electric field as it passes along the expanding portion of the horn. The pattern and size of the helical coil located within the horn is selected so that it adds to the delay experienced by the wall current so that the current will lag the displacement current in the middle of the horn by approximately a half wave length at the edge of the horn.

The helical coil can be formed on a mold or pattern to give it a shape and size which will fit snugly against the interior walls of the horn, whether it be conical, rectangular, square or other shape. A convenient size of copper wire can be coated with a mixture of paste-like material containing a solder, and the entire assembly would be assembled cold in the horn. Thereafter, the assembly is put into an oven where it is heated to melt the solder and cause the wire to adhere to the inner surface of the horn. Thus, the present invention provides a much simpler and more easily constructed structure than the corrugated surface which requires complex machining of the interior surface of the horn, and eliminates the space required for a hood.

BRIEF DESCRIPTION OF THE DRAWINGS

FIG. 1 is a section along line 1—1 of FIG. 2 through the center line of a rectangular horn at the end of a rectangular wave guide and showing the progressive curving of the E field plane as it passes along the horn;

FIG. 2 is an end elevational view along line 2—2 of FIG. 1 illustrating a typical instantaneous direction of the electric field vector E, the magnetic field vector H and the Poynting vector for a wave emerging from the horn antenna;

FIG. 3 is an illustration of the E plane electric field radiation pattern of the horn antenna of FIG. 1 showing the various side lobes that are produced because of radiation from the upper and lower edges of the horn aperture of FIG. 1;

FIG. 4 is a perspective view of the helical wound coil having a cross section fitting snugly into the interior of the horn and the number of turns being selected for clarity;

FIG. 5 is a section along line 5—5 of FIG. 4 showing the helical coil in place within the horn of the antenna with side coil portions removed to better illustrate progressive curving of the E plane;

DESCRIPTION OF THE PREFERRED EMBODIMENT

Figure 6:
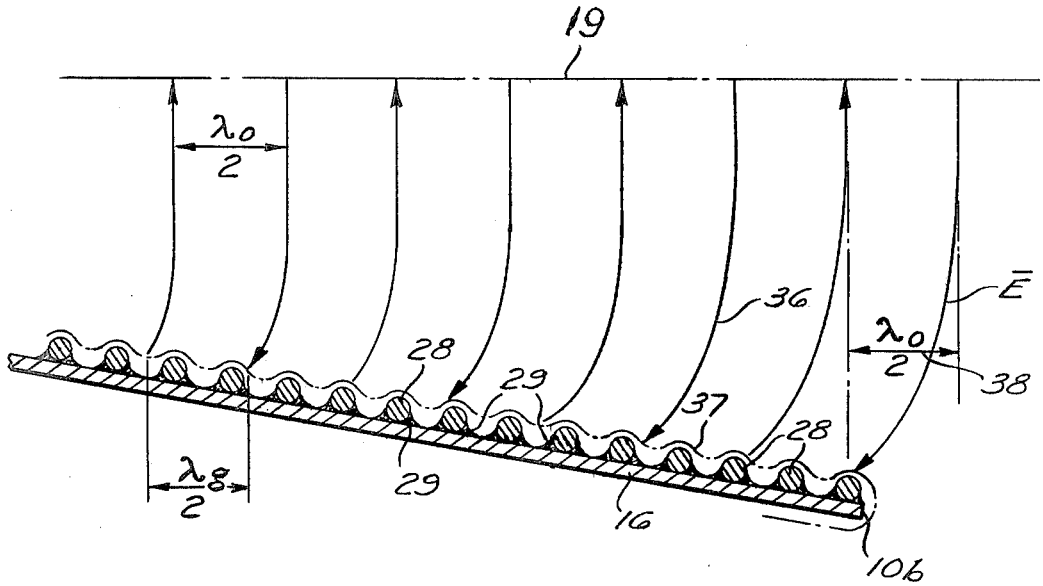
FIG. 6 is an enlarged section of the horn wall along line 606 of FIG. 4 showing the manner in which the E plane is progressively curved along the horn.

Referring to FIGS. 1 and 2, the antenna consists of a horn portion 10 fed by a wave guide 11. The rectangular configuration at the mouth is formed by two sides 12 and 14 and top and bottom plates 15 and 16. As illustrated in FIG. 1, all of the panels flare outwardly at an angle with respect to the axis 19 of the wave guide 11 so that, as illustrated in FIG. 1, the length of the bottom panel 16 is L sec $\phi$.

FIG. 3 illustrates in solid line the normal shape of the E plane electric field which is radiated from the horn antenna of FIG. 1. The pattern consists of main lobe 20 and a number of side lobes, such as 21, 22 and 23, which result from radiation from the hot spots 17 at the aperture of the antenna (see FIG. 2). It is the side lobe energy which causes unwanted coupling between antennas installed in proximity to one another. The E plane is conventionally called the plane which contains the direction in which the electrical field might be detected. The rectangular horn of FIGS. 1 and 2 is a continuation of the rectangular wave guide. It is understood that the present invention can be utilized with a circular or square horn antenna or a horn of any other shape. FIGS. 1 and 2 illustrate the electric field vector E, the magnetic field vector H and the Poynting (power flow) vector P. In the E plane shown in FIG. 3, the large side lobes are close to and in fact, coalesce with the main lobe 20. The pattern traveling in space is characterized by the electrical field which oscillates in the E plane and the magnetic field which is always at right angles to the E field.

The invention encompasses placing a continuous wire coil 28 (see FIG. 4) adjacent the interior surface of the horn. This coil is wound as a helix but having the cross sectional shape of the interior of the horn. It can be wound on a form which corresponds to the interior shape of the horn, allowing for wire thickness, so that the coil fits snugly on the interior surfaces of the top, bottom and side panels of the horn. The coil 28 is secured within the horn 10 of FIG. 5 by welding, soldering or in any other suitable manner. The effect of the coil 28 is to increase the travel time for that portion of the electric field of the wave near the horn wall. An enlargement of the lower horn panel 16 is illustrated in FIG. 6 and the coil 28 is shown secured to the surface 16 by solder fillets 29 on each side of the wire.

The addition of the coil structure on the horn surface changes the way the electric wave goes through that portion of the horn and rearranges the electric field and the magnetic field so that the side lobes are reduced in the far zone. FIG. 5 illustrates the progressive travel of the E plane 36 from the throat 10*a* of the horn to the exit aperture lip 10*b*. The effect of the coil is to slow down the energy near the walls so that it arrives out at the aperture later than it normally would because of the slow down caused solely by the wall itself. This slow down gives the effect of changing the shape of the E plane radiation pattern. The dimension of coil 28 is designed so that when the E plane leaves the mouth of the horn, the electric field at the horn surface is out of phase with the interior electric field by approximately one-half wave length. Thus, as the E plane 36 emerges from the mouth of the horn, the side lobes developed at the horn mouth edge will be substantially canceled by energy from the main lobe 20 and a directional pattern illustrated by the dotted line 34 in FIG. 3 will result in the far zone, where the pattern does not substantially change with increasing distance from the antenna. Thus, the side lobes are reduced significantly by controlling the electric field distribution inside the horn before it is radiated from the horn. As the wave arrives at the aperture, a portion of the wave is pushed in one direction and the net effect is that part of the wave cancels another part. Thus, destructive interference results.

The current line 37 of FIG. 6 illustrates the current which flows in the top and bottom surfaces of the wave guide. This line 37 is illustrative of only one of an infinite number of paths. Referring to the one isolated path of current shown in FIG. 6, the electric field which drives this current would exist between the side walls of the wave guide and would be maximum in the center and then die out away from center towards the sides. Alternate current systems sliding along, one after another, would be oriented in the same way except that currents would be flowing in opposite directions. By the addition of the coil 28, a current sheet illustrated by the line 37 on the top and bottom of the wave guide spreads out over the top and bottom panels and then it goes out of the horn walls. By insertion of the coils 28, the current is forced to flow around the wires and this takes a little longer so that the travel time to the horn aperture is greater. By delaying the portion of the wave near the walls by half a wave length, the portion of the wave near the wall at the aperture gets there almost at the same time as another portion traveling nearer the center of the opposite polarity so that one portion will substantially cancel the other portion.

Referring again to FIG. 6, it is noted that the E plane lines 36 are spaced apart by a distance of approximately $$\frac{\lambda o}{2}$$

at the center line and that each of these lines curve progressively as it moves over the coil 28 along the wall 16. It is further noted that the wave along the wall 16 has a wave length $$\frac{\lambda g}{2}$$

and has been delayed by a distance $$\frac{\lambda o}{2}$$

as it leaves the aperture as indicated by line 38. This has resulted because the current represented by line 37 has had to cover a much greater distance by traveling over the wire turns and the fillets along the surface 16. The effect of the coil is to delay the transmission along the surface of the horn so that it becomes out of phase with the transmission at the center of the horn and the transmission from the aperture edges of the horn will be canceled by a portion of the transmission from the center of the horn. Since the field is an alternating one at the wall, at one instant the charges on the wall would be positive and a very short time later, they would be of opposite sign. As the wave goes by, it moves the charges out of the interior of the metal itself and result in a bunch of charges drifting along the surface which is the current 37. Every half wave length this current would reverse.

The current arriving at the aperture edge 10*b* has to whirl around the end of the wall, and when it does, it radiates energy pretty much in all direction. This results because the charges are accelerated by changing direction and radiate energy as electromagnetic wave. The portion of the wave near the center line of the antenna, is already coupled from the conducting part so it comes out and radiates over considerable angles, also. The combination of these two sources of radiation, one from the edge of the aperture and the other from the interior at some distance away will substantially cancel before the energy reaches the far zone if there is a proper delay along the edge so that they arrive at the aperture in opposite phase.

Referring to the resulting dashed line pattern 34 of FIG. 3, the coil 28 serves to cancel radiation from the hot spots 17 and the resulting E plane pattern appears electrically to be in the wave guide that is supplying the horn. As noted, the effect of coil 28 is to reduce the side lobes 21, 22 and 23 and produce the dashed line pattern 34.

Figure 7:
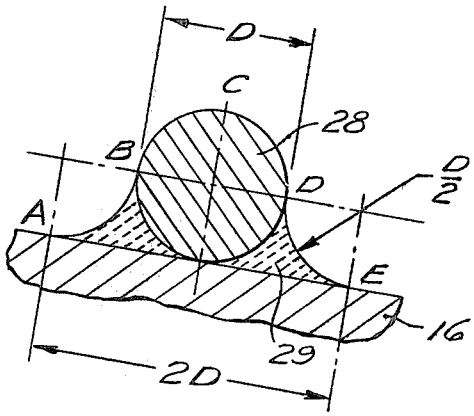
FIG. 7 is an enlarged fragmentary section of the wire of FIG. 5 showing the weld fillets, holding the coil to the interior horn surface.

As previously stated, the wave of current flowing along top and bottom walls of the horn must be delayed because it must follow a longer path than that portion of the electromagnetic wave which propagates well away from the walls. Referring to FIG. 7, the difference in the two distances a wave of current must travel between points A and E is illustrated in FIG. 7 and formulated as follows:

$$\overline{ABCDE} - \overline{AE} = (\tfrac{1}{4}\pi D + \tfrac{1}{2}\pi D + \tfrac{1}{4}\pi D) - 2D = (\pi - 2)D = \delta$$

where D is the wire diameter. In order to cause the smoothest feasible transition between the unperturbed portion of the wave inside the horn antenna and well away from the wall, it is necessary to make use of a large number of small perturbations of a small wire coil to produce a gradual transition to the delayed portion of the wave. In other words, several small perturbations per wave length are desirable rather than one relatively large one.

Referring to FIG. 6, a delay equivalent to a half a wave length is desired and such delay can be accomplished over a distance, for example, of six inches. Also, experience indicates at least six perturbations or turns per wave length are needed for a gentle transition between velocity regimes. Thus, there are three factors which define the required delay along the horn walls;

a. The length of the tilted, unperturbed sides are given by L sec ($\phi$);

b. the additional path length the current must flow over the wires is $(\pi-2)$ n$\lambda$d;

c. a half wave length difference in path length between the current path along the walls and the central axis.

Combining all three factors, the delay equation becomes $$\frac{2\pi}{\lambda}[L\sec(\phi)+(\pi-2)n\lambda d-L]=\frac{2\pi}{\lambda}\left(\frac{-\lambda}{2}\right)$$

where 'L' is the axial length of the horn, '$\phi$' is the angle of the horn surface to the axis, '$\lambda$' is the wave length of the radiated energy, 'n' is the number of wires per wave length and 'd' is the wire diameter.

This equation solved for the diameter of a wire which will cause the desired delay is as follows:

$$d=\frac{L(\sec(\phi)-1)+\lambda/2}{(\pi-2)n\lambda}$$

In a typical example, the following values are used:

L=6 inches $\lambda$=1 inch (wave length)

$\phi$=15 degrees n=16 turns per wave length then, d=0.039 inch

Brown & Sharpe wire gauge No. 18 is the nearest standard size.

Other examples, varying only n, the number of wires per wave length, yield:

| n | d | 1/n |
|---|---|---|
| 3 | .208 | 0.333 |
| 6 | .104 | 0.167 |
| 12 | .052 | .083 |
| 16 | .039 | .063 |
| 24 | .026 | .042 |

Referring again to FIG. 4, the coil shape is sometimes referred to as a helix but need not be a circular helix since the cross section can be rectangular or square as well. The form of the coil 28 in FIG. 4 can be produced by winding on a form block having the same shape as the interior of the horn except for the thickness of the wire. The wire coil could be removed by simply sliding it off the block into the horn or, if a block were made of some easily destructible material, the block could be destroyed rather than sliding the horn off the block. The coil can be coated with some paste material containing solder. After the coil is assembled cold in the horn, it is later put into an oven which is at a high enough temperature to melt the solder which would then form the fillets 29 illustrated in FIGS. 6 and 7. The fillets are then allowed to cool and the horn can then be removed from the oven.

It is understood that various other ways of securing the coil to the horn can be utilized, and that the invention is subject to various modifications such as various horn shapes, various wire sizes and spacings and various wave lengths, all of which determine the dimensions of the coil which is to be inserted and attached to the inner surface of the horn. It is apparent that the structure of the invention permits easy structural modification of an antenna to substantially eliminate side lobes which can cause unwanted coupling with the radiation from adjacent antenna. While the antenna has been discussed as a radiation device, the advantages of the present invention also prevents unwanted coupling when operating in the receiving mode. Although the mode of operation has been described in terms of a half-wave length difference in wave travel to secure maximum effect in canceling side lobes of the radiation pattern, substantial reduction of the side lobes will occur even when the delay is not equivalent to a half wave length. Beneficial results should be obtained from a well designed helix for delays equivalent to about 70% of optimum (a half wave length) to about 140% of the optimum.

What is claimed is:

1. An antenna construction for reducing the side lobes of a radiation pattern comprising:

a wave guide;

an antenna horn connected with said wave guide and having a horn wall arranged at an angle to the axis of said wave guide; said antenna radiating an energy in an E plane;

a helical coil of wire secured to the interior surface of said horn wall and having substantially the same shape as said wall;

the diameter of said wire and the number of coil turns along said horn wall being such as to delay the portion of the E plane at the aperture of said antenna horn sufficiently to make said delayed portion out of phase with the E plane portion propagated away from said horn wall.

2. An antenna construction as defined in claim 1 wherein;

said coil is secured to said horn by fillets on each side of said wire to provide a smooth transition to said delayed portion.

3. An antenna construction as defined in claim 2 wherein;

said helical coil provides at least six turn perturbations along said horn wall per wave length of the propagated E. plane in order to provide said smooth transition.

4. An antenna construction as defined in claim 3 wherein;

said fillets comprise solder which is radiused from approximately the center diameter of said wire to the horn wall.

5. An antenna construction as defined in claim 4 wherein the diameter of said wire is determined by the formula $$d=\frac{L(\sec(\phi)-1)+\lambda/2}{(\pi-2)n\lambda}$$

wherein 'L' is the length of the horn, '$\lambda$' is the wave length, '$\phi$' is the divergent angle of the horn wall from the axis, and "n" is the number of turns per wave length.

* * * * *